US007938755B1

(12) United States Patent
Dyer et al.

(10) Patent No.: US 7,938,755 B1
(45) Date of Patent: May 10, 2011

(54) ADJUSTABLE EXERCISE DEVICE

(75) Inventors: David E. Dyer, Renton, WA (US); Donald A. Demuth, Snohomish, WA (US); Mark D. Sand, Olympia, WA (US); Rodney P. West, Kirkland, WA (US); Patrick J. Waite, Renton, WA (US)

(73) Assignee: Precor Incorporated, Woodinville, WA (US)

( * ) Notice: Subject to any disclaimer, the term of this patent is extended or adjusted under 35 U.S.C. 154(b) by 720 days.

(21) Appl. No.: 10/187,054

(22) Filed: Jun. 28, 2002

(51) Int. Cl.
*A63B 22/00* (2006.01)

(52) U.S. Cl. ..... 482/54

(58) Field of Classification Search ..... 402/54
See application file for complete search history.

(56) References Cited

U.S. PATENT DOCUMENTS 2,578,871 A 12/1951 Woldring
4,364,222 A * 12/1982 Ramacher ..... 56/328.1
4,616,822 A * 10/1986 Trulaske et al. ..... 482/54
5,184,988 A 2/1993 Dunham
5,279,528 A 1/1994 Dalebout et al.
5,649,882 A * 7/1997 Parikh et al. ..... 482/54
5,769,757 A 6/1998 Fulks
5,810,701 A 9/1998 Ellis et al.
6,013,011 A 1/2000 Moore et al.
6,179,753 B1 1/2001 Barker et al.
6,478,720 B1 * 11/2002 Barker ..... 482/54
6,716,142 B2 * 4/2004 Kuo ..... 482/54

* cited by examiner

*Primary Examiner* — Stephen R. Crow

(57) ABSTRACT

An exercise treadmill (20) is described having a number of assembly improvements. In one embodiment, a pivot assembly (50) is provided to allow a treadmill deck (32) to deflect during use. The rear pivot assembly includes a pin (56) transversely mounted on the upper surface of a treadmill frame (22). A pivot block (54) is attached to the deck and includes a lower channel (58) that engages the pin. In another embodiment, an adjustable rear foot assembly (70) is provided having a foot (74) that is rotatable within a mounting block (72). The foot is easily accessed through an upper opening (96) in the treadmill. In yet another embodiment, an air dam (100) is provided between a motor compartment (102) and an adjacent endless belt (28). In still another embodiment, a highly elastic drivebelt (120) is used between a motor assembly (104) and a roller assembly (24) that drives the endless belt (28). Lastly, an embodiment is described in which the treadmill frame (22) is assembled using swaged fasteners (38).

11 Claims, 9 Drawing Sheets

ADJUSTABLE EXERCISE DEVICE

FIELD OF THE INVENTION

The present invention relates to exercise equipment, and more particularly to improvements in the functioning and assembly of exercise equipment.

BACKGROUND OF THE INVENTION

Exercise equipment, such as treadmills, is widely used in spas, exercise clubs, and in individual residences to enable users to walk, jog, or run indoors. This is especially useful during inclement weather and also at night or at other times when exercisers do not desire to run outdoors. Structurally, most exercise treadmills include first and second roller assemblies that are transversely mounted at the ends of an essentially rectangular frame. An endless belt is entrained about the roller assemblies. The upper run of the belt is supported by an underlying deck positioned between the belt and the frame.

Known treadmills include a number of disadvantages relating to their assembly. For example, some treadmill manufacturers bolt the rear of the deck to the frame, in effect, creating a diving-board configuration. This increases the stresses in the deck and results in a stiff feel to the user. Thus, it is desirable to include components in a treadmill that allow the rear of the deck to deflect in response to the steps taken by the user on the treadmill belt. Known deflection systems include a short aluminum pivot pin welded onto the rear inner surface of each side rail. The pins extend inwardly a short distance. A small upright plate is bolted to the rear underside surface of the deck at each corner and extends downwardly therefrom in a longitudinal orientation. The plate includes a circular opening at its center. As assembled, the pivot pin is held in the circular opening, thus allowing the deck to pivot relative to the frame. The above system, however, is costly to manufacture, has many parts that require maintenance, and does not have a streamlined appearance.

It is also known to include rear elevation adjustment components on the frame in order to even out the elevation of each rear corner of the treadmill. In one known system, a relatively flat rear foot is attached to a bolt that is insertable in a nut located on the underside of the frame. To raise and lower the foot, the user must use a wrench to manually adjust each column relative to its corresponding nut. This requires the user to assume a physically awkward position and to locate the nut, which is visually hard to see.

Further, it is known to use a standard poly-V belt (i.e., a belt profile that contains multiple V grooves) in driving the roller assemblies from the motor. The material used in a standard V belt is often nylon or a low-stretch polyester tensile cord. Low-stretch belts are applied with the center-to-center distance between the motor drive pulley and the front axle being less than is needed during use. This allows the installer to place a slack belt around both components. The drive pulley and front roller pulley are then pushed apart while the belt tension is monitored. Once the desired belt tension is achieved, the motor is secured in place. Because these standard belts have a low stretch capability, any small variation in the center-to-center distance results in a large variation in the belt tension. It is not infrequent that such standard belts are installed with an unnecessary overtension. Overtensioning a drivebelt is undesirable as it can be a factor in creating early bearing failure in motors.

Another problem with known treadmill assemblies is the tendency for debris to pass between the endless belt and the motor compartment. Such debris can interfere with the workings of the motor compartment components and/or the endless belt. Lastly, the frames of treadmills are currently made using welds or bolts between frame elements. Disadvantages of using welds include that they are time consuming to accomplish; they can affect the minimum configurable size of the subassemblies; and they can decrease the efficiency in painting and prepping the frame. Likewise, using bolts also has disadvantages. Because the frame is under random vibration loads, conventional bolts will require retorquing after a period of time to ensure a solid working joint.

Thus, there are multiple needs for improvement to known treadmill assemblies. An ideal machine would allow for efficient rear pivoting of the deck, an easy method of raising and lowering the frame's rear elevation, an easy method of assembling the drivebelt between the motor assembly and roller assembly, a reduction in the transference of debris between the motor compartment and the deck belt, and an improved connection between the frame's structural elements. The present invention is directed to fulfilling such needs and others, as described below.

SUMMARY OF THE INVENTION

In accordance with the teachings of the present invention, an exercise treadmill is described having a number of assembly improvements. In one embodiment, a rear pivot assembly is provided to allow a treadmill deck to deflect during use. The rear pivot assembly includes a pin transversely mounted on the upper surface of a treadmill frame. A pivot block is attached to the deck and includes a lower channel that engages the pin. In another embodiment, an adjustable rear foot assembly is provided, having a foot that is rotatable within a mounting block. The foot is easily accessed through an upper opening in the treadmill. In yet another embodiment, an air dam is provided between a motor compartment and an adjacent endless belt. In still another embodiment, a highly elastic drivebelt is used between a motor and the roller assembly that drives the endless belt. Lastly, an embodiment is described in which the treadmill frame is assembled using swaged fasteners.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
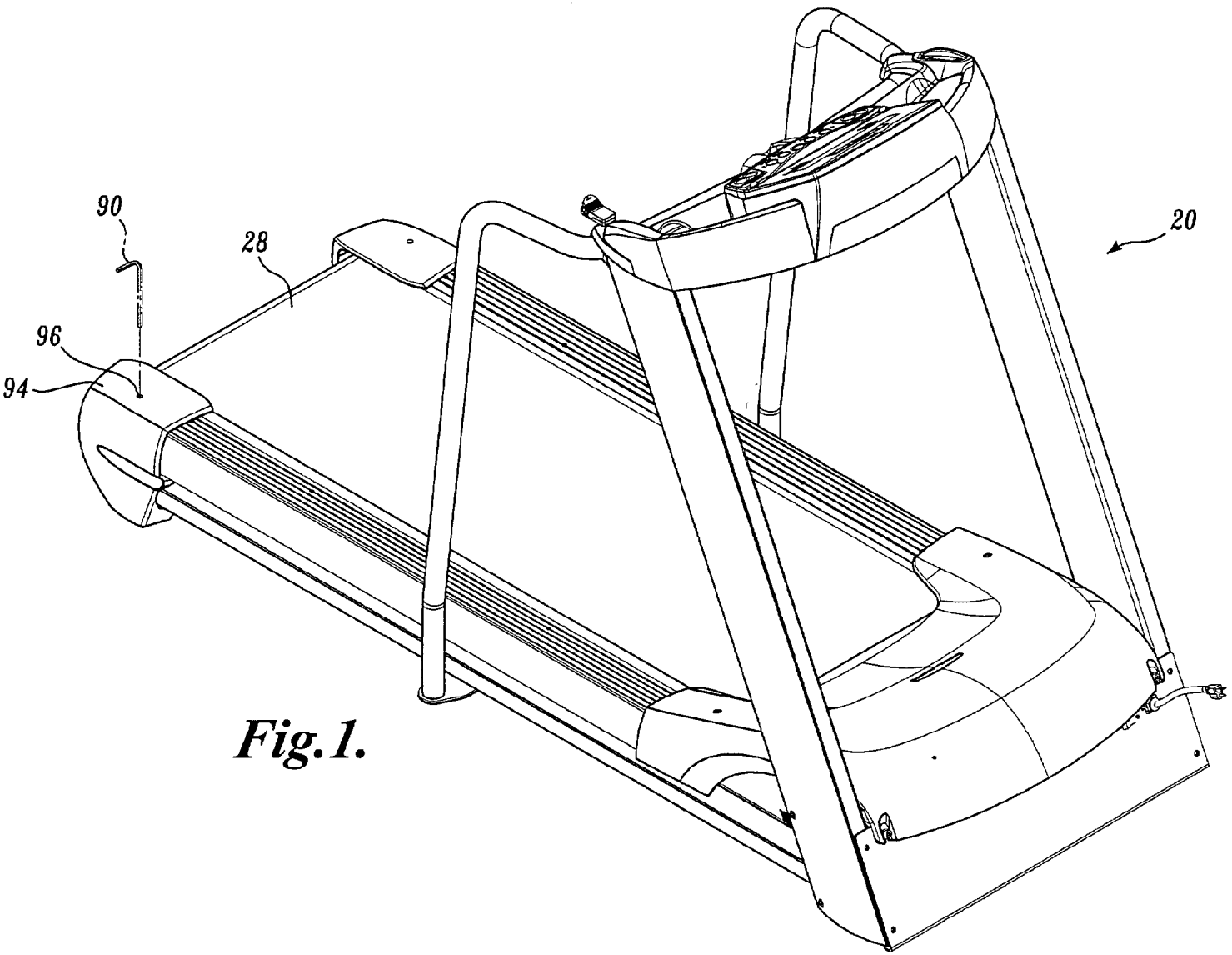
FIG. 1 is a perspective view of a treadmill formed in accordance with the present invention.

FIG. 1 is a perspective view of one embodiment of an assembled treadmill 20 formed in accordance with the present invention. As will be appreciated by a reading of the following description, there are numerous aspects to this invention. Such aspects may be used together in a single machine or used singularly in separate machines. Further, such aspects may be use on various types of exercise equipment, not just treadmills. Thus, the present invention is not limited to a treadmill having all of these aspects but, instead, is addressed to exercise equipment in general, having any one or more of the various improvements described herein.

Figure 2:
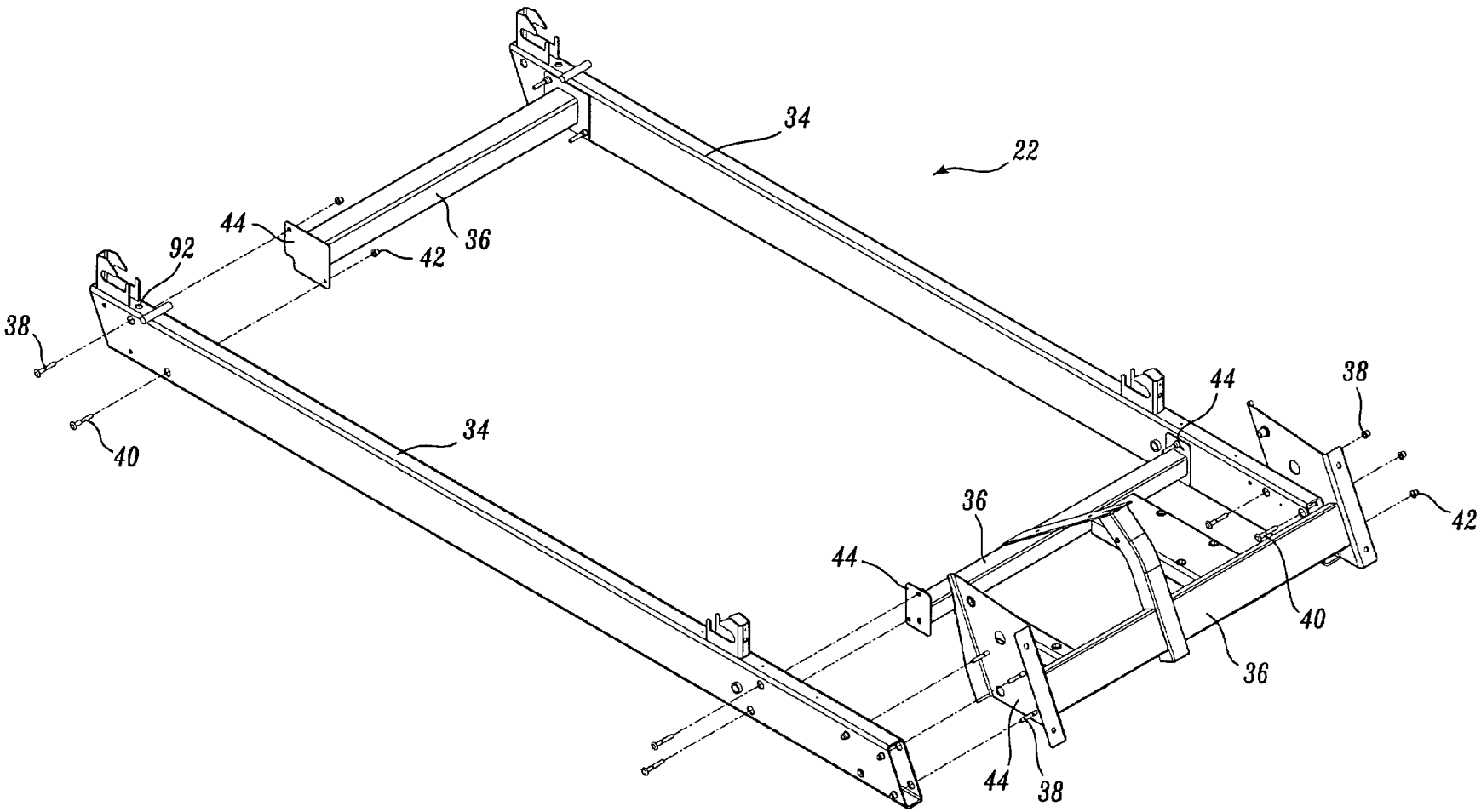
FIG. 2 is a perspective exploded view of a frame for use in a treadmill formed in accordance with the present invention.
Figure 3:
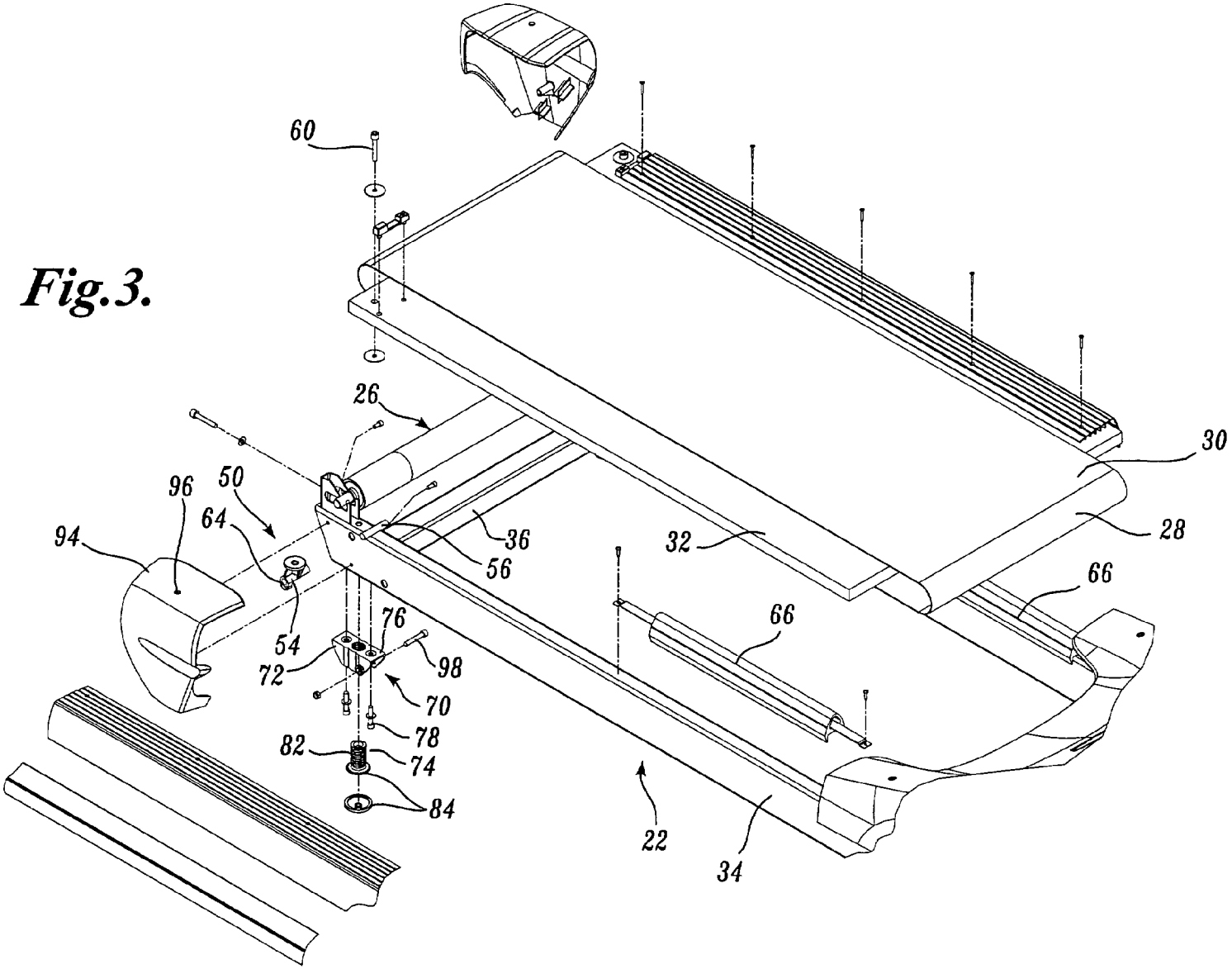
FIG. 3 is a perspective exploded detail view of rear portions of a treadmill formed in accordance with the present invention.
Figure 8:
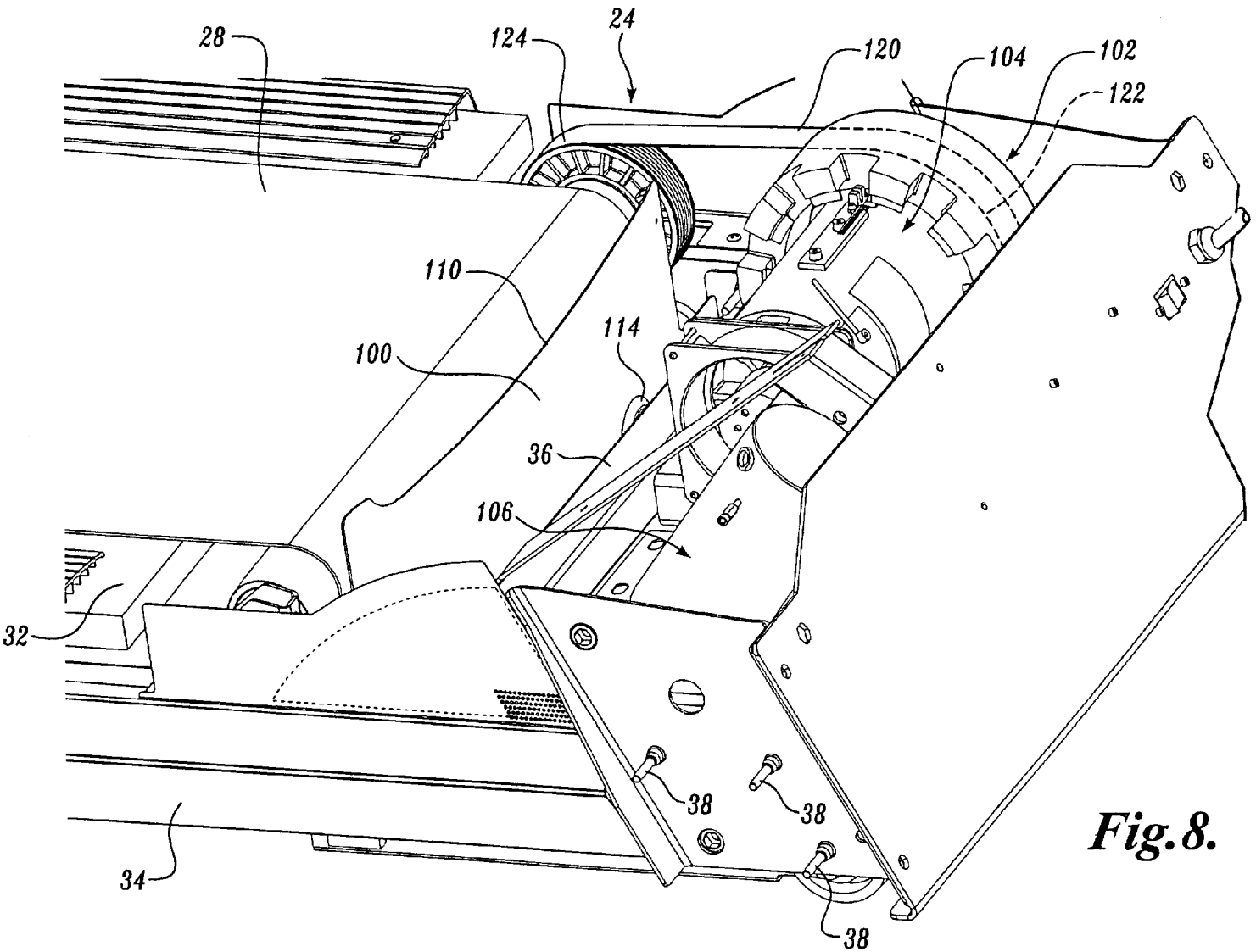
FIG. 8 is a perspective detail view of the forward end of a treadmill illustrating one embodiment of an air dam formed in accordance with the present invention.

Referring to FIGS. 2, 3, and 8, the treadmill includes a frame 22 on which is mounted a forward roller assembly 24 and a rearward roller assembly 26. The roller assemblies are mounted transversely to the longitudinal direction of the frame 22. For purposes of the present application, including the claims herein, the designation "forward end" refers to the direction in which the exerciser faces when using the treadmill. The terms "rearward" and "forward" refer to opposite directions. An endless belt 28 is entrained about the forward and rearward roller assemblies 24, 26. The upper run 30 of the belt 28 is supported by an underlying deck 32 positioned between the belt and the frame 22.

As shown best in FIG. 2, the frame 22 includes a pair of side rails 34 and one or more transverse connecting rails 36. According to aspects of this invention, the frame rails are preferably interconnected using permanently installed swaged fasteners 38. Such fasteners generally include a pin 40 and a mating collar 42, or crimp nut. In the embodiment of FIG. 2, the transverse rails include various end flanges 44 through which the fasteners extend and are crimped to the side rails. In the crimping process, the pin 40 is inserted through the flange and the side rail. The mating collar 42 is installed on the emerging end of the pin. The collar is then crimped onto the emerging end, thus locking the fastener into position. One swaged fastener that has been shown to be useful is the PowerBolt™ fastener, sold by Huck Fasteners, of Cortant Technologies, recently acquired by Alcoa Industrial Components of Salt Lake City, Utah.

The swaged fasteners offer a number of advantages over the practice of welding the frame components together, as was done for prior-art machines. The fasteners result in smaller weldments and allow for smaller frame assemblies that ease the handling and space requirements for painting and prepping the frame. Assembling the frame 22 using swaged fasteners has also been found to provide a viable ground path between frame components, which allows a manufacturer to eliminate the need for masking the frame prior to painting.

Using swaged fasteners is also advantageous over using conventional bolts. Because the frame is under random vibration loads, conventional bolts will require retorquing after a period of time to ensure a solid working joint. In contrast, swaged fasteners consist of a collar swaged into a pin that has large radial grooves. This design eliminates the potential for vibrating loose over time. In addition, a conventionally bolted joint is only as good as the preload applied to a bolt by proper torque applied to the bolt's corresponding nut. This torque can vary substantially depending on nut run-on torque (inherent torque between nut and bolt as the nut is spun on), presence or lack of lubricant on the bolt or nut, and the amount of access available when installing the bolt and nut. Swaged fasteners are installed with a swaging gun and are, therefore, insensitive to run-on torque, lubricants, or ease of installation. Fastener preload is consistent and assured.

As stated above and referring to FIG. 3, the deck 32 is positioned between the upper run 30 of the belt and the frame 22. In accordance with further aspects of this invention, the rearward portion of the deck is mounted to the frame 22 by a pivot assembly 50 to allow the rearward portion of the deck to pivot about an axis transverse to the longitudinal direction of the frame. Deformable springs are mounted to the frame 22 to underlie the side margins of the deck in order to support the deck in conjunction with the pivot assembly. In the embodiment of FIG. 3, the springs take the form of cushions 66 placed between the deck pivot assembly and the front of the deck, e.g., along its forward one-third region.

Figure 4:
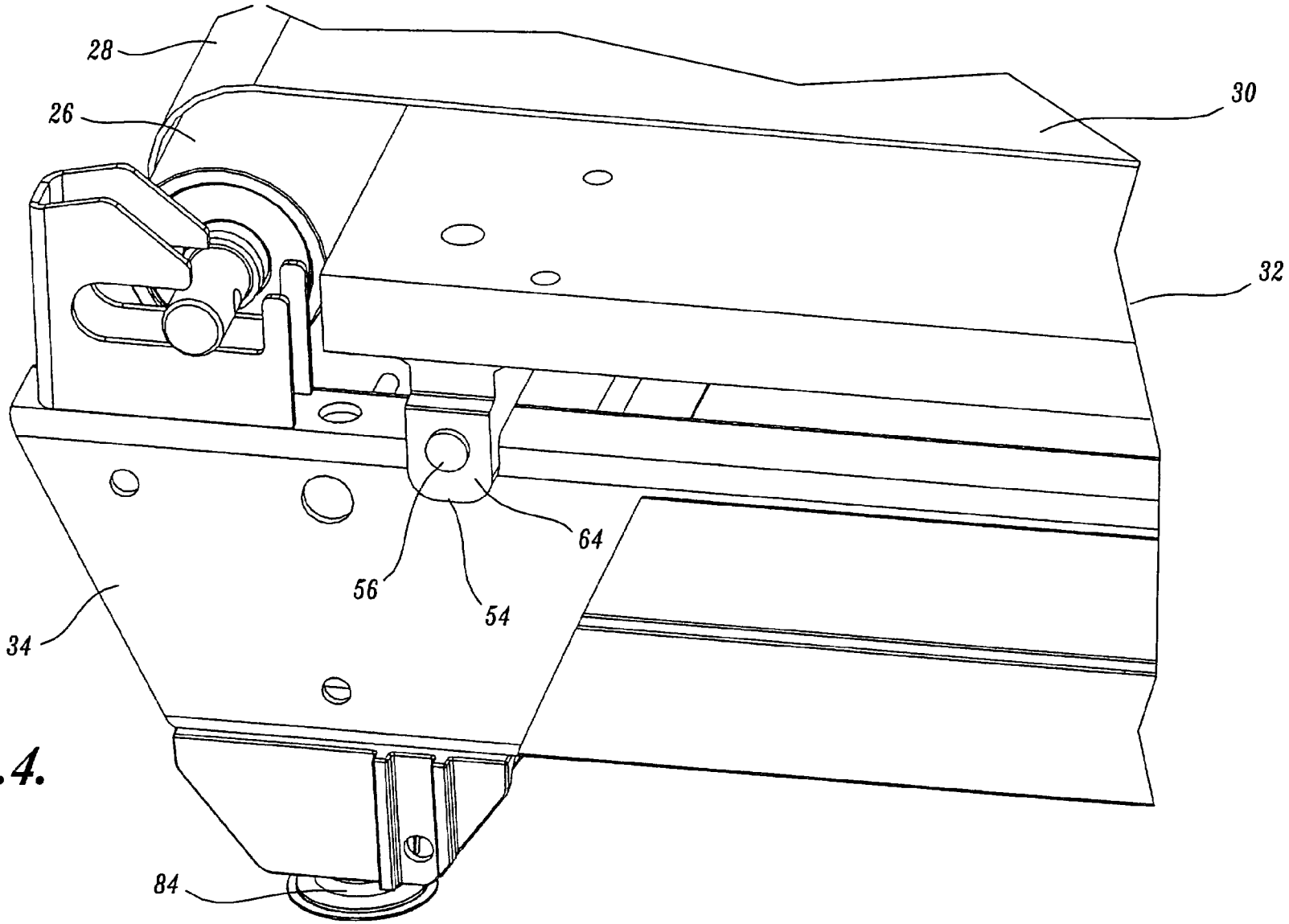
FIG. 4 is a perspective detail view of one embodiment of a rear pivot assembly formed in accordance with the present invention.
Figure 5:
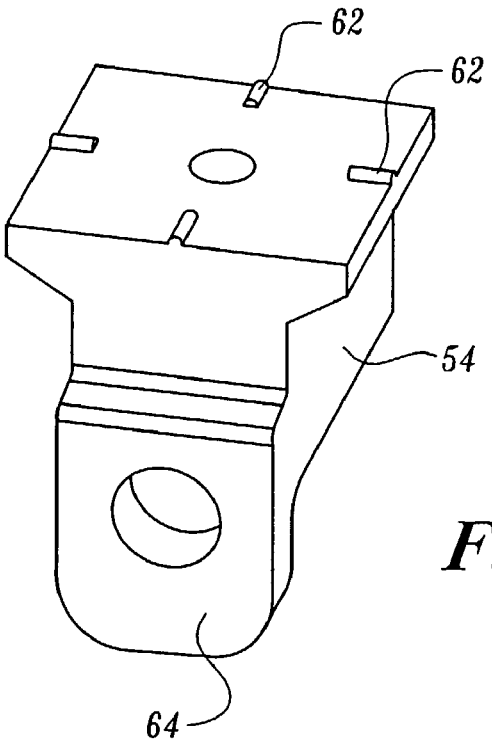
FIG. 5 is a perspective view of the pivot block of FIG. 4, showing one side of the block.
Figure 6:
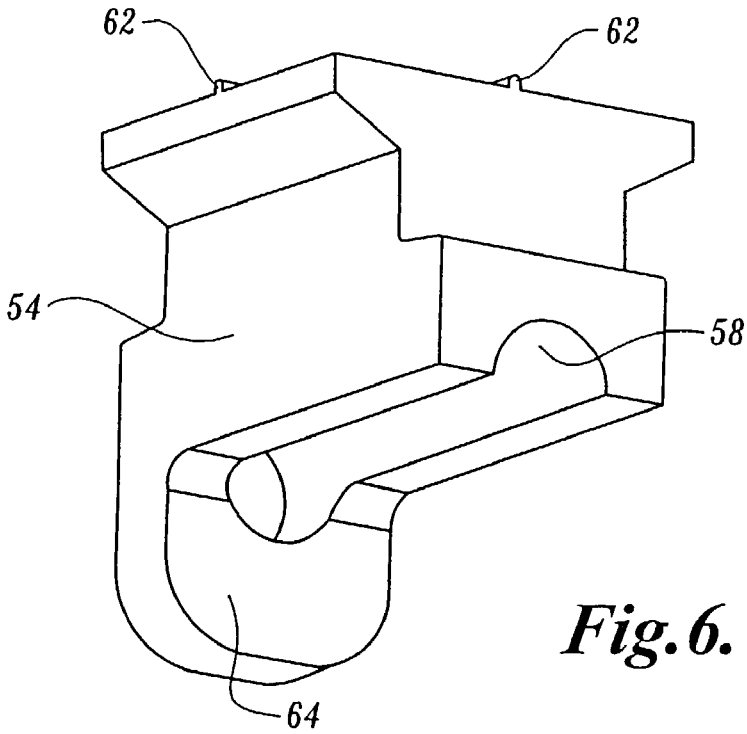
FIG. 6 is a perspective view of the pivot block of FIG. 5, showing the opposite side of the block.

Referring also to FIGS. 4, 5, and 6, the pivot assembly 50 includes a pair of pivot blocks 54 that rest on pins 56 that are transversely connected to the side rails 34. Each pivot block 54 includes a semicircular channel 58 along its underside that engages the block's corresponding pin 56. The pivot block may be made of any number of suitable materials. One preferred material is an injection-molded elastomer. The pin may be made as a separate component and then attached to the rail (e.g., by welding), or may be integrally made with the rail at its formation. The pivot block 54 is attached to the underside of the rear of the deck using conventional fasteners 60. See FIG. 3. A number of ribs 62 preferably extend from an upper surface of the block. The ribs provide friction at the connection between the pivot block and the undersurface of the frame.

A side flange 64 formed in the pivot block overhangs the side rail of the frame to prevent the deck from slipping sideways on the frame 22 and/or lifting vertically from it. The pin allows the rear deck to behave as a pinned joint, providing a comfortable feel to the user. The optional cushions 66 provided between the side rails and the deck further control deck deflection. See FIG. 3. As will be appreciated from a reading of the above, the pivot assembly is less costly, more reliable, has fewer parts, and has an improved appearance over known pivot configurations.

Figure 7:
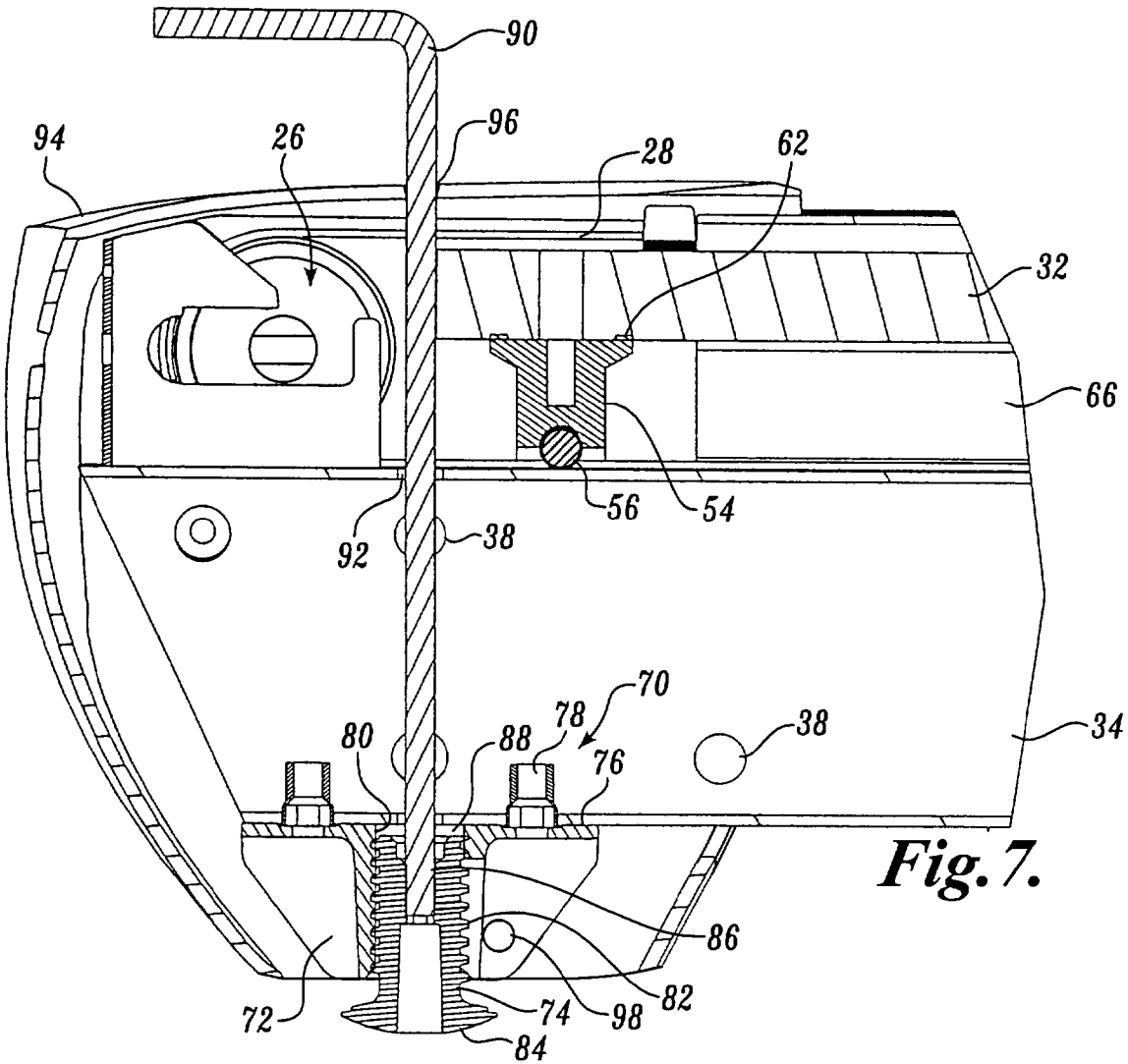
FIG. 7 is a cross-sectional side view of the rear portions of a treadmill formed in accordance with the present invention, showing one embodiment of a rear foot adjustment assembly and an assembled view of the rear pivot assembly of FIG. 4.

Referring now to FIGS. 3 and 7, in accordance with other aspects of this invention, the rear portion of the treadmill includes a rear foot adjustment assembly 70 for raising or lowering the rear of the treadmill. Such movement is desired in order to even out the elevation of each rear corner of the treadmill. It may also be used to give a slight incline to the endless belt. The rear foot adjustment assembly 70 includes a mounting block 72 and an adjustable foot 74. There are, preferably, two assemblies provided, one at each rear corner of the treadmill frame 22. The mounting block 72 has an upper support surface 76 that attaches to the underside of a side rail using conventional fasteners 78. A threaded central passage 80 is formed in the block to accept the adjustable foot. The passage 80 extends at least from the underside of the block upward, and may optionally extend completely through the block (as is shown in FIG. 7). The foot 74 includes an elongated threaded column 82 and a relatively flat lower support piece 84. The support piece 84 is connected to, or made integral with, the lower end of the threaded column 82. Interior to the column 82 is a hex-shaped bore 86. An opening 88 in the upper surface 76 of the mounting block aligns with the bore 86. The opening 88 in the embodiment of FIG. 7 coincides with the extended central passage 80.

Adjustment of the foot 74 relative to the mounting block 72 is accomplished by inserting a hex wrench 90 into the hex bore and rotating the wrench. This causes the foot to rotate within the threaded central passage of the block, thus raising or lowering the foot, depending on the orientation of the threads. The foot stays in position due to tightly controlled acme thread tolerancing. Various openings 92 are provided in the frame side rails as necessary to allow the wrench to be inserted from the top of the treadmill. If an optional end cap 94 is provided on each rear corner, such end cap also includes a hole 96 to allow passage of the wrench. See FIG. 3. As will be appreciated from a reading of the above, the rear foot adjustment assembly allows the user to easily adjust the rear foot from the top of the treadmill, without having to lift the back end of the machine or assume an awkward position in order to find the foot or insert the wrench.

An optional positive locking device can also be incorporated into the assembly to result in an adjustable rotation resistance or a ratcheting feel. In the embodiment of FIG. 3, the locking feature includes a side tightening screw 98 located in the block 72, adjacent the threaded column 82 of the foot. Tightening or loosening this screw increases or decreases the resistance experienced by the user in adjusting the rear foot mechanism.

Figure 9:
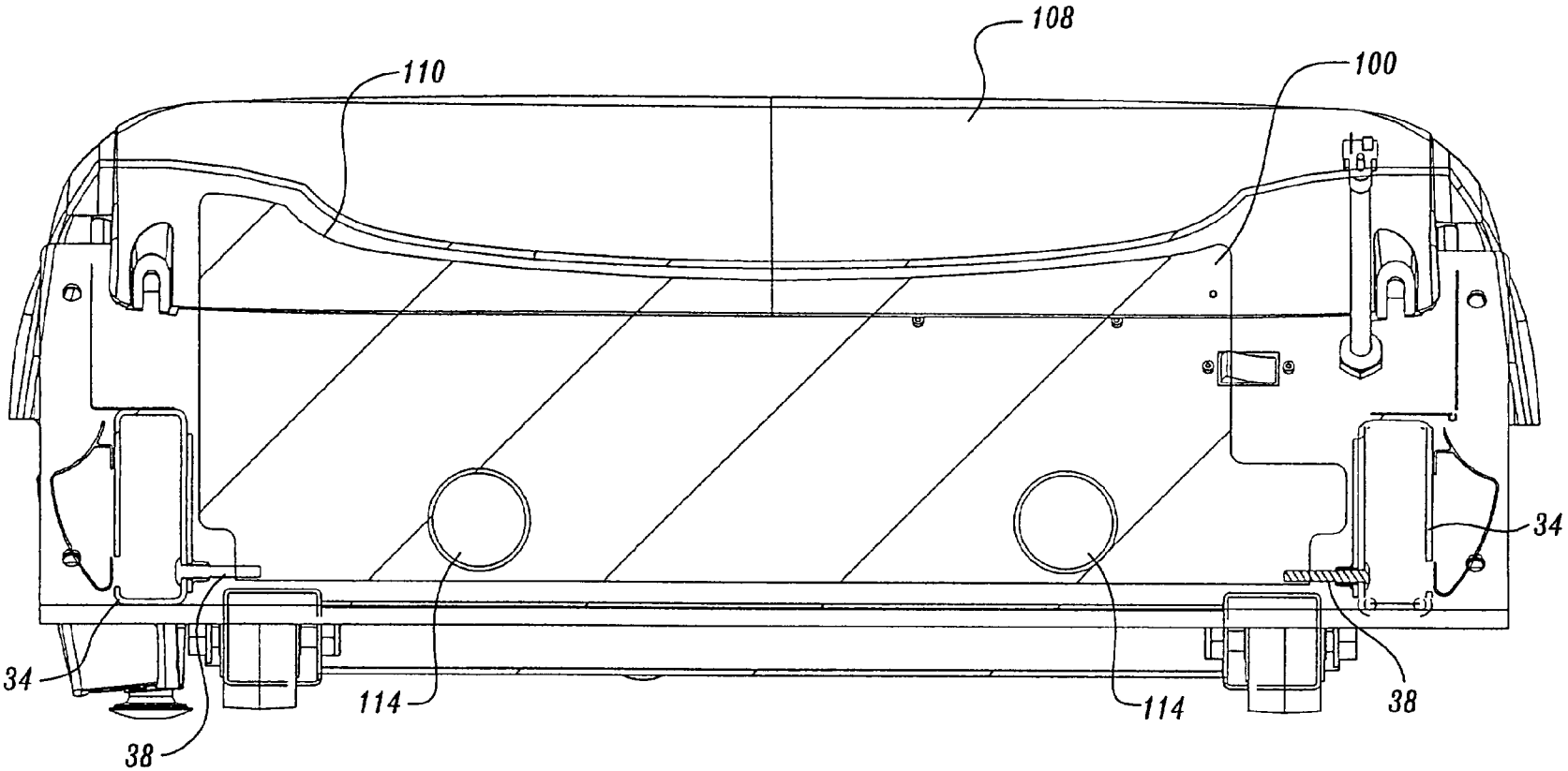
FIG. 9 is a cross-sectional side view of the air dam of FIG. 8.
Figure 10:
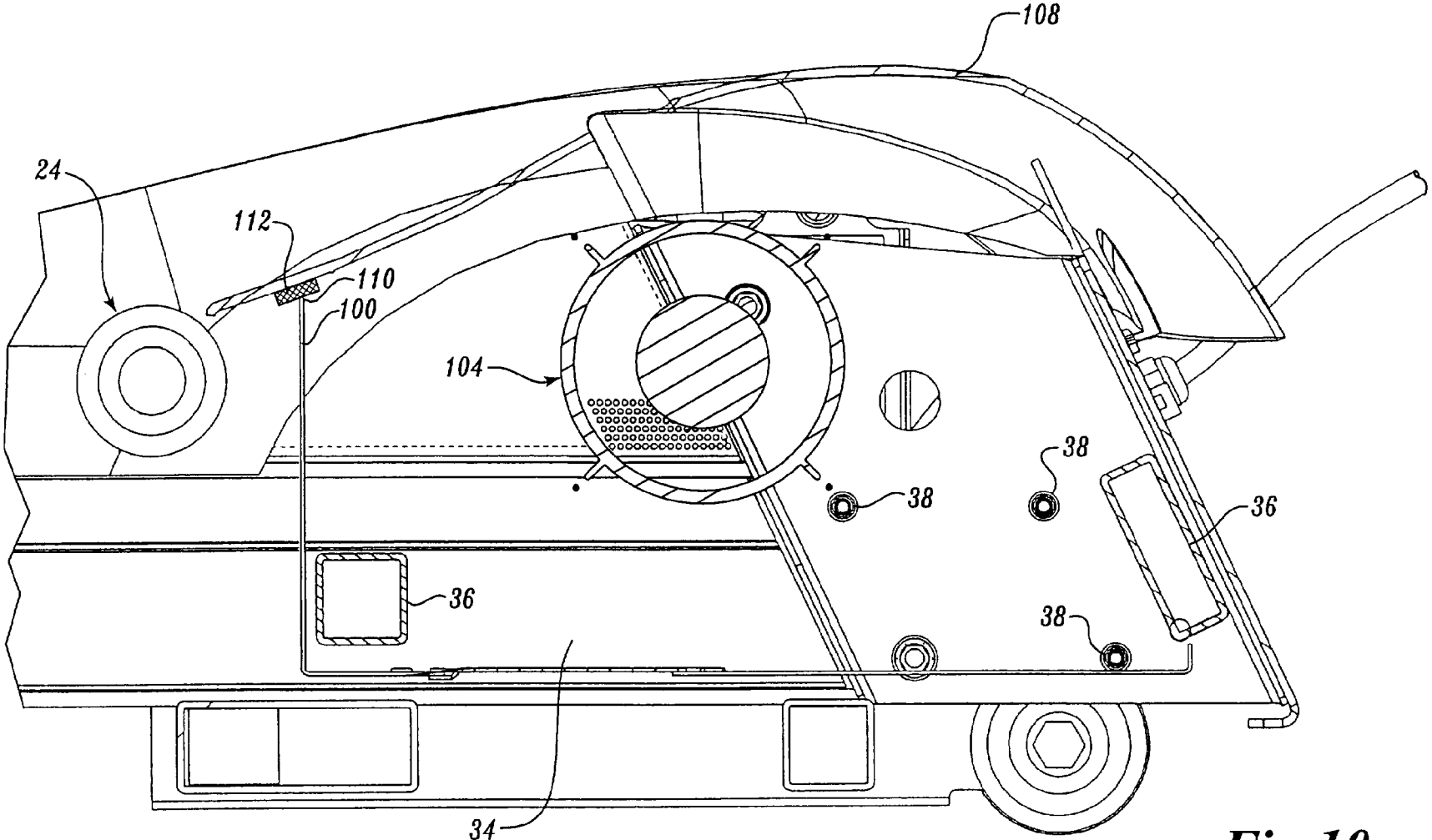
FIG. 10 is a cross-sectional side view looking rearward of the air dam of FIG. 8.

In accordance with yet other aspects of this invention, an air dam 100 is provided between the endless belt 28 and the other working components of the treadmill. In the embodiment of FIGS. 8, 9, and 10, a motor compartment 102 is located at the forward end of the treadmill, just ahead of the forward roller assembly 24 and the forward turn of the endless belt 28. The motor compartment 102 houses a motor assembly 104 and a number of electronic components 106 for controlling power and operating the motor assembly. A forward hood 108 closes out the motor compartment, the forward roller assembly, and the forward turn of the endless belt. See particularly FIG. 1.

Referring to FIGS. 9 and 10, the air dam 100 is located within the motor compartment 102, between the motor assembly 104 and the forward roller assembly 24 and endless belt 28. The air dam 100 may be essentially a thin upright plate of metallic, plastic, or other material that extends the width of the compartment, from one side rail to the other side rail. As shown, an upper edge 110 of the air dam 100 may be shaped to follow the contour of the hood 108. An optional seal 112 may be provided to further close any marginal space left between the air dam and the hood. See FIG. 10. Referring back to FIG. 9, optional openings 114 may be provided in the air dam 100 to allow access to other components, as necessary. The openings may be nominally closed by plugs or caps sized to fit within the openings.

The air dam effectively reduces the amount of debris passing between the endless belt and the motor compartment. This works advantageously both ways. The treadmill often collects debris from a user's shoes. This belt debris can be distributed into the motor compartment when the endless belt makes its forward turn. The debris can interfere with the workings of the motor assembly and/or the electronic control components. Likewise, oil and/or other fluid can be distributed onto the endless belt from the motor assembly. The air dam is a wall that is sealed up against the hood to reduce these cross-contaminations. The air dam profile may follow the hood profile, thus providing a minimal gap for material to pass through. This increases the life of the motor and the electronics, and reduces outflow of any errant fluids or mists.

Referring to FIG. 8, the forward roller assembly 24 is rotatably mounted on bearings on a front axle (not shown). The front axle is disposed transversely relative to the frame side rails 34. The motor assembly 104 is connected to the front roller assembly via a drivebelt 120 looped about a drive pulley 122 on the motor and a roller pulley 124 mounted on the front roller. Translation of the drivebelt 120 by the drive pulley 122 causes rotation of the roller pulley 124 and roller, and corresponding movement of the endless belt 28.

In accordance with yet further aspects of this invention, the drivebelt 120 is formed of a highly tensionable elastomeric material. In one embodiment, the highly elastic belt has a total tension per rib (in pounds) of zero for a belt having an effective length in the range of about 27 inches to about 27-5 inches. The total tension per rib increases generally linearly to about 35 pounds for the belt when it has an effective length in the range of about 29 inches to about 29.5 inches. Thus, per inch, the highly elastic drivebelt exhibits about 0.6 to about 1.0 pounds per rib, a preferred amount being about 0.8 pounds per rib. One drivebelt that has yielded good results is product No. 10217-132 manufactured by the Dayco PTI company of Redwing, Minn. Further, in one embodiment, the drivebelt accomplishes such elasticity by utilizing nylon cord.

The initial installation of the highly elastic belt preferably includes a pretensioning step (similar to prestretching a balloon prior to filling). A conventional pneumatic tensioning device may be used for this purpose. The drive pulley and the roller pulley are then placed close together. In one embodiment, the roller pulley is at a fixed location and the drive pulley is made to translate. Alternatively, the drive pulley may be held constant and the roller pulley be made movable, or both components may be movable. In any event, the drive pulley and roller pulley are positioned closer together than they would be during normal use. The belt is slipped around both pulleys, preferably with a small preload. The pneumatic tensioning device is then used to pull or push the motor assembly away from the roller pulley a predefined distance and the motor assembly is then secured in place. Because of the flexibility in the highly elastic belt, this method can be used without the belt tension climbing rapidly as the pulley center-to-center distance changes. Once the drivebelt is installed, the belt tension will relax to its desired tension due to the elasticity properties of the material.

In one embodiment, the lax center-to-center distance between the drive motor pulley and the roller pulley is in the range of about 8.5 inches to about 9.5 inches, a preferred distance being approximately 9.2 inches. The motor assembly is then slid forward using the pneumatic tensioning device to create a tensioned center-to-center distance in the range of about 9 inches to about 10 inches, a preferred distance being approximately 9.5 inches. Using the preferred distance, the belt allows the center-to-center distance to vary by up to about 0.25 inch and still maintain an adequate belt tension. Such variation is within the manufacturing tolerances of many exercise equipment manufacturers. In other embodiments, the tensioned center-to-center distance is less than 9 inches, e.g., 7 inches.

In general, it is not known to use highly elastic belts to span such small distances, i.e., those less than about 14 inches center-to-center. There are a number of advantages in doing so. Such belts eliminate the need for complex tensioning parts and a more time-consuming installation method, as is currently in place with older technology belts. Using this belt also significantly reduces the overtensioning of the drivebelt, which can contribute to motor bearing failures. The belt may be rolled onto the pulleys at a low tension, then the motor to be secured to a predetermined location, all without requiring the service technician or assembly line worker having to simultaneously monitor belt tension.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. In a treadmill having a frame, a motor compartment, a roller assembly located adjacent the motor compartment, and an endless belt entrained about the roller assembly; an improvement comprising an air dam located between the motor compartment and the roller assembly and connected to the frame; the air dam extending generally a majority length of the roller and substantially isolating the motor compartment from the endless belt; whereby the air dam substantially reduces airflow and cross-contamination of debris between the endless belt and the motor compartment.

2. The air dam improvement according to claim 1, wherein the air dam is an upright plate.

3. The air dam improvement according to claim 2, wherein the treadmill further includes a cover panel located over portions of the roller assembly and motor compartment at the location of the air dam; the cover panel having an inside contour; the air dam having an upper portion that follows the inside contour of the cover panel.

4. The air dam improvement according to claim 3, further comprising a seal between the upper edge of the air dam and the inside contour of the cover panel; the seal thereby helping to close off the motor compartment and the roller assembly areas.

5. The air dam improvement according to claim 2, wherein the roller assembly is a forward roller assembly and the motor compartment is located forward of the forward roller assembly.

6. The air dam improvement according to claim 2, wherein the air dam includes at least one opening to allow access into the motor compartment.

7. The air dam of claim 2, wherein the body includes at least one opening to allow access into the motor compartment.

8. An air dam for a treadmill, the treadmill having a frame, a motor compartment, a roller assembly located adjacent the motor compartment, and an endless belt entrained about the roller assembly, the air dam comprising:

a plate-like body having upper and lower portions, the body configured to be positioned between the motor compartment and the roller assembly and to be connected to the frame; the air dam extending generally a majority length of the roller and substantially isolating the motor compartment from the endless belt;

whereby the air dam substantially reduces airflow between the endless belt and the motor compartment.

9. The air dam of claim 8, wherein the air dam is configured for substantially upright placement within the treadmill.

10. The air dam of claim 9, wherein the treadmill further includes a cover panel located over portions of the roller assembly and motor compartment at the location of the air dam, wherein the cover panel has an inside contour, and wherein the upper portion of the body is formed to follow the inside contour of the cover panel.

11. The air dam of claim 10, further comprising a seal between the upper edge of the air dam and the inside contour of the cover panel; the seal configured to facilitate closing off of the motor compartment area from the roller assembly area.

* * * * *